US012523012B1

(12) United States Patent
Kotlaba et al.

(10) Patent No.: US 12,523,012 B1
(45) Date of Patent: Jan. 13, 2026

(54) CONFIGURABLE SYSTEM FOR LAYERED SYSTEM CONTROL OF EARTH-MOVING CONSTRUCTION AND/OR MINING VEHICLES

(71) Applicant: AIM Intelligent Machines, Inc., Monroe, WA (US)

(72) Inventors: Robert Kotlaba, Most (CZ); Jonathan D. Hurwitz, Seattle, WA (US); Colin Szechy, Bellevue, WA (US)

(73) Assignee: AIM Intelligent Machines, Inc., Redmond, WA (US)

( * ) Notice: Subject to any disclaimer, the term of this patent is extended or adjusted under 35 U.S.C. 154(b) by 36 days.

(21) Appl. No.: 18/768,809

(22) Filed: Jul. 10, 2024

Related U.S. Application Data

(60) Provisional application No. 63/532,007, filed on Aug. 10, 2023.

(51) Int. Cl.
*E02F 9/20* (2006.01)

(52) U.S. Cl.
CPC ..... *E02F 9/205* (2013.01); *E02F 9/2041* (2013.01)

(58) Field of Classification Search
CPC ..... E02F 9/205; E02F 9/2041
See application file for complete search history.

(56) References Cited

U.S. PATENT DOCUMENTS

| | | | | |
|---|---|---|---|---|
| 6,798,343 | B2 | 9/2004 | Carrier et al. | |
| 8,473,140 | B2 * | 6/2013 | Norris | B60W 60/0051 701/23 |
| 8,554,896 | B2 | 10/2013 | Sodergren et al. | |
| 9,863,117 | B2 * | 1/2018 | Calvert | E02F 3/3627 |
| 11,375,041 | B2 | 6/2022 | Theverapperuma et al. | |
| 11,494,930 | B2 | 11/2022 | Theverapperuma et al. | |
| 11,560,690 | B2 | 1/2023 | Halder et al. | |
| 11,567,197 | B2 | 1/2023 | Halder | |
| 11,746,499 | B1 | 9/2023 | Kotlaba | |
| 11,746,501 | B1 | 9/2023 | Gajic et al. | |
| 11,898,324 | B1 | 2/2024 | Hurwitz et al. | |
| 11,952,746 | B1 | 4/2024 | Kotlaba et al. | |
| 2019/0123952 | A1 | 4/2019 | Hrabak et al. | |
| 2020/0111169 | A1 | 4/2020 | Halder et al. | |

(Continued)

FOREIGN PATENT DOCUMENTS

| | | | |
|---|---|---|---|
| CN | 115205395 | A | 10/2022 |
| EP | 4083335 | A2 | 8/2022 |

(Continued)

OTHER PUBLICATIONS

Grove—12 Bit Magnetic Rotary Position Sensor (AS5600), retrieved on Aug. 22, 2022 from wiki.seeedstudio.com/Grove-12-bit-Magnetic-Rotary-Position-Sensor-AS5600/, 13 pages.

(Continued)

*Primary Examiner* — Russell Frejd
(74) *Attorney, Agent, or Firm* — VLP Law Group LLP; James A. D. White

(57) ABSTRACT

Systems and techniques are described for a configurable system for layered control of earth-moving construction and/or mining vehicles. For example, the systems and techniques may inject signals into a variety of physical button and lever conditions to allow for a machine emulator to virtually mimic the physical button and lever conditions.

22 Claims, 6 Drawing Sheets

(56) References Cited

U.S. PATENT DOCUMENTS

| | | | |
|---|---|---|---|
| 2020/0150650 | A1 | 5/2020 | Jarlengrip |
| 2020/0150687 | A1 | 5/2020 | Halder et al. |
| 2020/0310442 | A1 | 10/2020 | Halder et al. |
| 2021/0017738 | A1 | 1/2021 | Sano |
| 2021/0254308 | A1 | 8/2021 | Thibblin et al. |
| 2021/0317633 | A1 | 10/2021 | Sherlock |
| 2022/0024485 | A1 | 1/2022 | Theverapperuma et al. |
| 2022/0026921 | A1 | 1/2022 | Halder |
| 2022/0042286 | A1 | 2/2022 | Tsuji et al. |
| 2022/0057513 | A1 | 2/2022 | Pihl |
| 2022/0154431 | A1 | 5/2022 | Kurosawa |
| 2022/0340171 | A1 | 10/2022 | Halder |
| 2023/0165501 | A1 | 6/2023 | Moghaddambagheri et al. |
| 2024/0093464 | A1 | 3/2024 | Sadilek et al. |

FOREIGN PATENT DOCUMENTS

| | | | |
|---|---|---|---|
| KR | 10-2022-0014477 | | 12/2022 |
| WO | 2018099755 | A1 | 6/2018 |
| WO | 2022198331 | A1 | 9/2022 |

OTHER PUBLICATIONS

ZED-F9P-04B u-blox F9 high precision GNSS module, May 3, 2022, retrieved on Aug. 22, 2022 from www.u-blox.com/sites/default/files/ZED-F9P-04B_DataSheet_UBX-21044850.pdf, 25 pages.
Digi XBee SX 868 Datasheet, retrieved on Aug. 22, 2022 from www.digi.com/resources/library/data-sheets/ds_xbee-sx-868, 2 pages.
St LM217/LM317 Datasheet, Dec. 2021, retrieved on Aug. 22, 2022 from www.st.com/resource/en/datasheet/Im317.pdf, 34 pages.
St LD1117 Datasheet, Feb. 2020, retrieved on Aug. 22, 2022 from www.st.com/resource/en/datasheet/ld1117.pdf, 46 pages.
Texas Instruments TCAN33x 3.3-V Can Transceivers With CAN FD, Dec. 2019, retrieved on Aug. 22, 2022 from www.ti.com/lit/gpn/TCAN334, 45 pages.
PJRC Teensy 4.1 Development Board, retrieved on Mar. 18, 2022 from www.pjrc.com/store/teensy41.html, 22 pages.
Fairchild Semiconductor ONSEMI N-Channel Logic Level Enhancement Mode Field Effect Transistor BSS138, Nov. 2021, retrieved on Aug. 22, 2022 from www.onsemi.com/pdf/datasheet/bss138-d.pdf, 7 pages.
NXP Semiconductors i.MX RT1060 Crossover MCU with Arm® Cortex®-M7 Core, retrieved on Aug. 22, 2022 from https://www.nxp.com/products/processors-and-microcontrollers/arm-microcontrollers/i-mx-rt-crossover-mcus/i-mx-rt1060-crossover-mcu-with-arm-cortex-m7-core:i.MX-RT1060, 9 pages.
LIVOX LVX Specifications v1.1.0.0, 2019, retrieved on Aug. 22, 2022 from www.livoxtech.com/3296f540ecf5458a8829e01cf429798e/downloads/Livox Viewer/LVX Specifications EN_20190924.pdf, 12 pages.
Inductive Proximity Sensor LJ12A3-4-Z/BX, retrieved on Aug. 22, 2022 from datasheetspdf.com/pdf-file/1096182/ETT/LJ12A3-4-Z/1, 1 page.
Brianna Wessling, "Teleo announces $12M in Series A funding", Jun. 13, 2022, retrieved on Jun. 20, 2022 from www.therobotreport.com/teleo-announces-12m-in-series-a-funding/, 10 pages.
Frank Tobe, "Blue River Technology sells to Deere for $305 million", Sep. 7, 2017, retrieved on Jun. 20, 2022 from www.therobotreport.com/startup-blue-river-technology-sells-deere-305-million/, 12 pages.
Steve Crowe, "John Deere Acquires Light's Camera-Based Perception Platform", May 19, 2022, retrieved on Jun. 20, 2022 from www.therobotreport.com/john-deere-acquires-light-camera-based-perception-platform/, 12 pages.
TRL Off-Highway Automated Vehicles Code Of Practice, 2021, retrieved on Aug. 22, 2022 from trl.co.uk/uploads/trl/documents/PPR994-Off-Highway-AV-CoP_v3.pdf, 40 pages.
Steve Crowe, "John Deere Acquiring Bear Flag Robotics For $250M", Aug. 5, 2021, retrieved on Jun. 20, 2022 from www.therobotreport.com/john-deere-acquiring-bear-flag-robotics-250m/, 11 pages.
Steve Crowe, "Oxbotica Pilots Safety Framework For Off-Road Autonomous Driving", Jun. 7, 2021, retrieved on Jun. 20, 2022 from www.therobotreport.com/oxbotica-pilots-safety-framework-off-road-autonomous-driving/, 11 pages.
Brianna Wessling, "MIT Researchers Help Robots Navigate Uncertain Environments", May 24, 2022, retrieved on Jun. 20, 2022 from www.therobotreport.com/mit-researchers-help-robots-navigate-uncertain-environments/, 10 pages.
Carnegie Mellon University National Robotics Engineering Center—Off-Road Autonomy, retrieved on Aug. 22, 2022 from https://www.nrec.ri.cmu.edu/solutions/defense/other-projects/off-road-autonomy.html, 5 pages.
Greg Nichols, "Off Road: Autonomous Driving's New Frontier Requires A New Kind Of Sensor", Apr. 14, 2021, retrieved on Jun. 20, 2022 from www.zdnet.com/article/off-road-autonomous-drivings-new-frontier-requires-a-new-kind-of-sensor/, 15 pages.
Tagolas Magma X2 Datasheet, retrieved on Aug. 22, 2022 from www.taoglas.com/datasheets/AA.175.301111.pdf, 20 pages.
LIVOX Mid-40/Mid-100 LiDAR Specs, retrieved on Aug. 22, 2022 from https://www.livoxtech.com/mid-40-and-mid-100/specs, 2 pages.
Elaine Ball, "Top Benefits Of Using LiDAR For Construction Projects", Oct. 1, 2020, retrieved from https://csengineermag.com/top-benefits-of-using-lidar-for-construction-projects/ on Nov. 4, 2022, 4 pages.
"Press Release: Baraja Announces First Volume Commercial LiDAR Deal With Hitachi Construction Machinery", Oct. 12, 2021, retrieved from https://www.baraja.com/en/blog/press-release-baraja-announces-first-volume-commercial-lidar-deal-with-hitachi-construction on Nov. 4, 2022, 6 pages.
Peter Brown, "LiDAR Improves Efficiency And Safety In Industrial Heavy Equipment", Oct. 22, 2021, retrieved from https://electronics360.globalspec.com/article/17336/lidar-improves-efficiency-and-safety-in-industrial-heavy-equipment on Nov. 4, 2022, 2 pages.
"Construction Remains Ahead In Autonomous Vehicles", Oct. 4, 2019, retrieved from https://www.constructionequipment.com/earthmoving/rigid-frame-trucks-off-highway/article/10756443/construction-remains-ahead-in-autonomous-vehicles on Nov. 4, 2022, 4 pages.
"LiDAR For Heavy Machinery", retrieved from https://innoviz.tech/applications/industrial on Nov. 4, 2022, 2 pages.
"Hitachi Construction Machinery Invests In Nextgen LiDAR . . . ", Mar. 29, 2021, retrieved from https://lidarnews.com/press-releases/hitachi-construction-machinery-invests-in-nextgen-lidar/ on Nov. 4, 2022, 2 pages.
Nakagawa et al., "Real-Time Mapping Of Construction Workers Using Multilayered LiDAR", The 40th Asian Conference On Remote Sensing 2019, Oct. 14-18, 2019, 8 pages.
Sabbir Rangwala, "LiDAR Vision—Helping Bring Autonomous Trucks To Your Neighborhood", Dec. 17, 2020, retrieved from https://www.forbes.com/sites/sabbirrangwala/2020/12/17/lidar-visionhelping-bring-autonomous-trucks-to-your-neighborhood/ on Nov. 4, 2022, 9 pages.
"Collision Warning On The Rear Of An Excavator With 3D LiDAR Sensors", retrieved from https://www.sick.com/ca/en/industries/mobile-automation/construction-and-mining-machines/excavator/collision-warning-on-the-rear-of-an-excavator-with-3d-lidar-sensors/c/p549945 on Nov. 4, 2022, 1 page.
"Autonomous Construction Vehicles", retrieved from https://www.technologycards.net/english/the-technologies/autonomous-construction-vehicles on Nov. 4, 2022, 2 pages.

* cited by examiner

CONFIGURABLE SYSTEM FOR LAYERED SYSTEM CONTROL OF EARTH-MOVING CONSTRUCTION AND/OR MINING VEHICLES

CROSS REFERENCE TO RELATED APPLICATIONS

This application claims the benefit of U.S. Provisional Patent Application No. 63/532,007, filed Aug. 10, 2023 and entitled "Configurable System For Layered System Control Of Earth-Moving Construction And/Or Mining Vehicles," which is hereby incorporated by reference in its entirety.

TECHNICAL FIELD

The following disclosure relates generally to systems and techniques for a configurable system that performs layered system control for autonomous operations of earth-moving construction and/or mining vehicles.

BACKGROUND

Earth-moving construction and mining vehicles may be used on a job site to move soil and other materials (e.g., gravel, rocks, asphalt, etc.) and to perform other operations, and are each typically operated by a human operator (e.g., a human user present inside a cabin of the vehicle, a human user at a location separate from the vehicle but performing interactive remote control of the vehicle, etc.). The human operator controls the movement of the various components of an earth-moving vehicle using joysticks and pedals attached to the different components. These earth-moving vehicle controls include physical safety levers, end stops, switches for various implements, and parking brakes that can be operated by the operator of the earth-moving vehicle.

Limited autonomous operations (e.g., performed under automated programmatic control without human user interaction or intervention) of some earth-moving vehicles have occasionally been used, but existing techniques suffer from a number of problems, including the use of limited types of sensed data, an inability to perform fully autonomous operations when faced with on-site obstacles, an inability to coordinate autonomous operations between multiple on-site earth-moving vehicles, requirements for bulky and expensive hardware systems to support the limited autonomous operations, etc.

SUMMARY

In some aspects, the techniques described herein relate to a configurable system for layered control of an earth-moving vehicle including: a machine interface that is configured to receive and transmit control signals of one or more of a button or a switch of the earth-moving vehicle; a machine emulator that is configured to generate a virtual signal mimicking the control signals of the one or more of the button or the switch of the earth-moving vehicle; and an adaptive control system that is configured to generate a set of movement instructions of the earth-moving vehicle, the adaptive control system receiving the virtual signal mimicking the control signal and enabling the virtual signal to effect an actuation of the earth-moving vehicle, the actuation mimicking the control signal of the one or more of the button or the switch of the earth-moving vehicle based on the virtual signal and the set of movement instructions.

In some aspects, the techniques described herein relate to a configurable system, wherein the control signals of the one or more of the button or the switch represent control signals from one or more of a safety lever, or an end stop, or an implement switch, or a parking brake.

In some aspects, the techniques described herein relate to a configurable system, wherein the machine emulator includes a jumper that emulates the one or more of the button or the switch performing, when activated, switching of a grounded COM to a powered pin.

In some aspects, the techniques described herein relate to a configurable system, wherein the jumper is implemented as software configured via an amplified bit mask.

In some aspects, the techniques described herein relate to a configurable system, wherein the amplified bit mask includes a plurality of relays, wherein each relay of the plurality of relays selects a different one of multiple routing paths.

In some aspects, the techniques described herein relate to a configurable system, wherein each of the plurality of relays provides a signal back to a connector that is read by a diagnostic system.

In some aspects, the techniques described herein relate to a configurable system, wherein the machine emulator includes a plurality of configurable jumpers that enable inputs of two or more of the jumpers from the plurality of jumpers to be swapped.

In some aspects, the techniques described herein relate to a configurable system, wherein the adaptive control system generates the set of movement instructions of the earth-moving vehicle by determining a current location of the earth-moving vehicle and determining a next action of the earth-moving vehicle based on the current location of the earth-moving vehicle and the virtual signal.

In some aspects, the techniques described herein relate to a configurable system for layered control of an earth-moving vehicle, including: a physical control of the earth-moving vehicle that when activated causes physical control data to be sent to a component of the earth-moving vehicle to cause an actuation of the component of the earth-moving vehicle; a machine interface that receives the physical control data from the physical control and interrupts the actuation of the component of the earth-moving vehicle; a machine emulator that receives the physical control data and generates a virtual signal mimicking the physical control data; and an adaptive control system that receives the virtual signal mimicking the physical control signal and enables the virtual signal to cause the actuation of the component of the earth-moving vehicle in place of the physical control data.

In some aspects, the techniques described herein relate to a configurable system, wherein the machine interface interrupts the actuation of the component of the earth-moving vehicle by causing the physical control data to not be sent to the component of the earth-moving vehicle.

In some aspects, the techniques described herein relate to a configurable system, wherein the physical control is a button on the earth-moving vehicle that is activated by a user physically pressing the button.

In some aspects, the techniques described herein relate to a configurable system, wherein the physical control is a switch on the earth-moving vehicle that is activated by a user physically moving the switch.

In some aspects, the techniques described herein relate to a configurable system, wherein the component of the earth-moving vehicle is one or more of a safety lever, or an end stop, or an implement switch, or a parking brake.

In some aspects, the techniques described herein relate to a configurable system, wherein causing the actuation of the component of the earth-moving vehicle includes causing the one or more of the safety lever, or the end stop, or the implement switch, or the parking brake to be engaged.

In some aspects, the techniques described herein relate to a configurable system, wherein the machine emulator includes a plurality of jumpers, and wherein generating of the virtual signal includes activating the plurality of jumpers to switch a grounded COM to a powered pin when activated.

In some aspects, the techniques described herein relate to a configurable system, wherein the generating of the virtual signal further includes causing the plurality of jumpers to swap inputs.

In some aspects, the techniques described herein relate to a method of using a configurable system for layered control of an earth-moving vehicle, including: receiving an indication to virtually generate a control signal to mimic a button or a switch on the earth-moving vehicle that engages a component of the earth-moving vehicle; generating a virtual signal based on the control signal, the virtual signal mimicking the control signal; and sending the virtual signal to the component of the earth-moving vehicle to engage the component of the earth-moving vehicle.

In some aspects, the techniques described herein relate to a method, wherein the virtual signal emulates the control signal using a plurality of jumpers.

In some aspects, the techniques described herein relate to a method, wherein the component of the earth-moving vehicle is one or more of a safety lever, or an end stop, or an implement switch, or a parking brake.

In some aspects, the techniques described herein relate to a method, further including: receiving a physical control signal representing an interaction with the button or the switch on the earth-moving vehicle; causing the virtual signal being to the component of the earth-moving vehicle to be interrupted; and sending the physical control signal to the component of the earth-moving vehicle to engage the component of the earth-moving vehicle.

DETAILED DESCRIPTION

Figure 1:
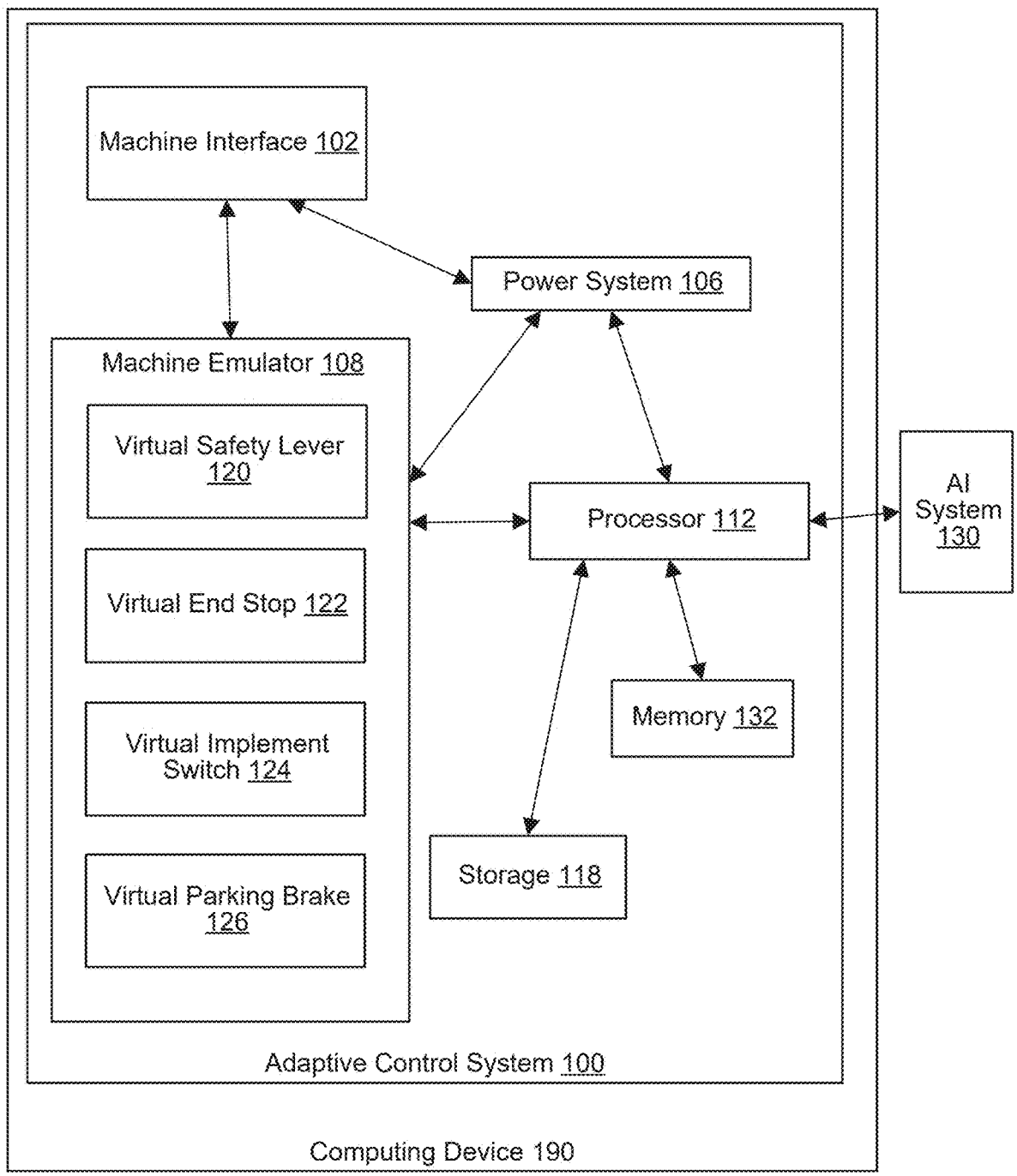
FIG. 1 is a diagram illustrating an example embodiment of using described systems and techniques for an adaptive control system of one or more powered earth-moving construction and/or mining vehicles on a site.

Systems and techniques are described for a configurable system that performs layered system control of operations of earth-moving construction and/or mining vehicles, such as a hardware component architecture for use in autonomous control of operations of one or more such vehicles on a site (e.g., to automatically determine and control movement of an excavator vehicle's boom arm, stick arm and tool attachment to move materials or perform other actions). In at least one embodiment, the layered system controls provide the ability to inject virtual signals that emulate physical control signals from physical activation of a variety of physical controls (e.g., as exemplary controls, buttons and/or switches) and produce resulting conditions for control of an earth-moving construction and/or mining vehicle while also preserving the original operating ability of the earth-moving construction and/or mining vehicle. In at least some embodiments, the described systems and techniques are used to perceive positions of one or more joysticks, pedals and other vehicle physical controls (e.g., switches, buttons, etc.) of a powered earth-moving construction and/or mining vehicle (referred to at times more generally herein as an "earth-moving vehicle"), and use those perceived positions as part of controlling the earth-moving vehicle, such as by modifying input control signals received from the physical controls and by sending output signals that can be transformed to various power levels for different components of one or more such earth-moving vehicles to implement fully autonomous operations of the earth-moving vehicles. Such earth-moving vehicles may include, for example, one or more tracked or wheeled excavators, bulldozers, front loaders, skip loaders, graders, cranes, backhoes, compactors, conveyors, trucks, deep sea machinery, extra-terrestrial machinery, demining ploughs, etc., and may each receive and implement one or more defined movement instructions (e.g., dig a hole of a specified size and/or shape and/or at a specified location, move one or more rocks from a specified area, trenching, breaching, etc.) and/or otherwise operate to accomplish one or more other goals, including in at least some embodiments and situations to do so when faced with possible on-site obstacles (e.g., man-made structures, rocks and other naturally occurring impediments, other equipment, people or animals, etc.) and/or to implement coordinated actions of multiple such earth-moving vehicles (e.g., multiple excavator vehicles, an excavator vehicle and one or more other construction and/or mining vehicles of one or more other types, etc.).

As one non-exclusive example, the described systems and techniques may in some embodiments include a hardware architecture that includes sensors of multiple types positioned at various different points on a powered earth-moving construction and/or mining vehicle (e.g., an excavator vehicle) at a site, and one or more hardware controllers (e.g., microcontrollers) used to obtain and analyze the sensor data that is used as inputs for determining movement instructions to control motion of one or more such vehicles and/or movement of one or more component parts of the one or more such vehicles, and the movement instructions can then be used to determine and send corresponding signal outputs to different components of the earth-moving vehicle. Additional details related to the hardware architecture and to related techniques for implementing autonomous control of powered earth-moving construction and/or mining vehicles in particular manners are described below, and in other embodiments some or all of the described techniques are performed by an earth-moving vehicle movement control system to control one or more such earth-moving vehicles of one or more types. While some illustrative examples are discussed below with respect to an adaptive control system to control one or more excavator vehicles, it will be appreciated that the same or similar techniques may be used to control one or more other non-excavator earth-moving construction and/or mining vehicles.

As noted above, in at least some embodiments, as shown with respect to FIG. 1, data may be obtained and used by the adaptive control system (ACS) 100 from sensors of multiple types positioned on or near a construction and/or mining vehicle, such as one or more of GPS location data, track and cabin heading data, visual data of captured image(s), depth data from LiDAR and/or other depth-sensing and proximity devices, infrared data, real-time kinematic positioning information based on GPS data and/or other positioning data, inclinometer data for particular moveable parts of an earth-moving vehicle (e.g., the digging boom arm/stick arm/tool attachment of an excavator vehicle), etc. For example, one or more types of GPS antennas and associated components may be used to determine and provide GPS data in at least some embodiments, such as for particular positions on the powered earth-moving vehicle's chassis at which the GPS antennas are mounted. In addition, one or more types of LiDAR devices may be used in at least some embodiments to determine and provide depth data about an environment around an earth-moving vehicle (e.g., to determine a 3D, or three-dimensional, model of some or all of a job site on which the vehicle is situated) and in some embodiments, other types of depth-sensing and/or 3D modeling techniques may be used, whether in addition to or instead of LiDAR, such as using other laser rangefinding techniques, synthetic aperture radar or other types of radar, sonar, image-based analyses (e.g., SLAM, SfM, etc.), structured light, etc. Furthermore, one or more proximity sensor devices may be used to determine and provide short-distance proximity data in at least some embodiments. Moreover, real-time kinematic (RTK) positioning information for components of an earth-moving vehicle may be determined from a combination of GPS data and other positioning data and/or a radio that receives RTK correction data. Other hardware components that may be positioned on or near an earth-moving vehicle and used to provide data and/or functionality used by the ACS include the following: one or more inclinometers (e.g., single axis and/or double axis) or other accelerometers; a CAN bus message transceiver; one or more low-power microcontrollers, such as to execute and use executable software instructions and associated data of the ACS 100; one or more voltage converters and/or regulators; a voltage level shifter; etc. In addition, in at least some embodiments and situations, one or more types of data from one or more sensors positioned on an earth-moving vehicle may be combined with one or more types of data (whether the same types of data and/or other types of data) acquired from one or more positions remote from the earth-moving vehicle (e.g., from an overhead location, such as from a drone aircraft, an airplane, a satellite, etc.; elsewhere on a site on which the earth-moving vehicle is located, such as at a fixed location and/or on another earth-moving vehicle of the same type or a different type; etc.), with the combination of data used in one or more types of autonomous operations as discussed herein.

As is also noted above, automated operations by the ACS 100 for an earth-moving vehicle may include determining current location and other positioning of the earth-moving vehicle on a site in at least some embodiments. As one non-exclusive example, such position determination may include using one or more track sensors (or wheel sensors in other embodiments) to monitor whether or not the earth-moving vehicle's tracks or wheels are aligned in the same direction as the cabin, and using GPS data (e.g., from three or more GPS antennas located on the earth-moving vehicle's cabin or other positions of an earth-moving vehicles chassis/body) in conjunction with inertial navigation system to determine the rotation of the cabin chassis (e.g., relative to true north), as well as to determine an absolute location of the vehicle's body and/or other parts. When using data from multiple GPS antennas, the data may be integrated in various manners, such as by using a microcontroller located on the earth-moving vehicle, and with additional RTK (real-time kinematic) positioning data used to provide an RTK-enabled GPS positioning unit that reinforces and provides further precision with respect to the GPS-based location (e.g., in some implementations, to achieve 1-inch precision or better). In addition, in some embodiments and situations, LiDAR data is used to assist in position determination operations, such as by surveying the surroundings of the earth-moving vehicle (e.g., an entire job site on which the earth-moving vehicle is located) and confirming a current location of the earth-moving vehicle (e.g., relative to a three-dimensional, or 3D, map of the job site generated from the LIDAR data). Additional details are included below regarding such automated operations to determine current location and other positioning of an earth-moving vehicle on a site.

In addition, automated operations using an ACS 100 may further include receiving instructions from an AI system 130 that determines at least some of the actions or movement commands to control movement of some or all of an earth-moving vehicle components (e.g., an excavator vehicle's boom arm, stick arm and/or tool attachment) to move materials or perform other actions for the one or more tasks on a job site or other geographical area, and with the ACS 100 used to send corresponding modular outputs to the earth-moving vehicle's components. In addition, the autonomous operations of the earth-moving vehicle to perform one or more tasks may be initiated in various manners, such as by an operator component of the AI system 130, in part or in whole based on input received from one or more human users or other sources, etc.

The activities of this non-exclusive embodiment may further be implemented by a system comprising one or more hardware processors; a plurality of sensors mounted on an earth-moving vehicle to obtain vehicle data about the earth-moving vehicle, including a real-time kinematic (RTK)-enabled positioning unit using GPS data from one or more GPS antennas on the cabin of the earth-moving vehicle, and one or more inclinometers; a plurality of additional sensors to obtain environment data about an environment surrounding the earth-moving vehicle, including at least one of one or more LiDAR sensors, or one or more image capture devices; and one or more storage devices having software instructions that, when executed by at least one processor of the one or more hardware processors, cause the at least one processor to perform automated operations to implement any or all of the activities described above, and optionally further comprising the earth-moving vehicle. The activities of this non-exclusive embodiment may further be implemented using stored contents on a non-transitory computer-readable medium that cause one or more computing devices to perform automated operations to implement any or all of the activities described above.

In addition, while the autonomous operations of an earth-moving vehicle controlled by the ACS 100 may in some embodiments be fully autonomous and performed without any input or intervention of any human users using the ACS 100, in other embodiments the autonomous operations of an earth-moving vehicle controlled by the ACS 100 may include providing information to one or more human users about the operations of the ACS 100 and optionally receiving information from one or more such human users (whether on-site or remote from the site) that are used as part of the automated operations of the AI system 130 (e.g., one or more target tasks, a high-level work plan, etc.), such as via one or more GUIs ("graphical user interfaces") displayed on one or more computing devices that provide user-selectable controls and other options to allow a user to interactively request or specify types of information to display and/or to interactively provide information for use by the ACS 100.

For illustrative purposes, some embodiments are described below in which specific types of data are acquired and used for specific types of automated operations performed for specific types of powered earth-moving construction and/or mining vehicles, and in which specific types of autonomous operation activities are performed in particular manners. However, it will be understood that such described systems and techniques may be used with other types of data and vehicles and associated autonomous operation activities in other manners in other embodiments, and that the invention is thus not limited to the exemplary details provided. In addition, the terms "acquire" or "capture" or "record" as used herein with reference to sensor data may refer to any recording, storage, or logging of media, sensor data, and/or other information related to an earth-moving vehicle or job site or other location or subsets thereof (unless context clearly indicates otherwise), such as by a recording device or by another device that receives information from the recording device. In addition, various details are provided in the drawings and text for exemplary purposes, but are not intended to limit the scope of the invention. For example, sizes and relative positions of elements in the drawings are not necessarily drawn to scale, with some details omitted and/or provided with greater prominence (e.g., via size and positioning) to enhance legibility and/or clarity. Furthermore, identical reference numbers may be used in the drawings to identify similar elements or acts that may be used to implement at least some of the described systems and techniques for implementing autonomous control of powered earth-moving construction and/or mining vehicles, such as to automatically determine and control movement of an earth-moving vehicle's hydraulic arm(s) and/or attachment(s) (e.g., a digging bucket) to move materials or perform other actions in accordance with specified tasks.

As noted above, FIG. 1 is a diagram illustrating an example embodiment of an Adaptive Control System ("ACS") 100. The ACS 100 may be implemented on one or more network-accessible configured computing devices 190, whether integrated with a particular earth-moving vehicle (e.g., such as located on an earth-moving vehicle, not shown in FIG. 1) or with multiple earth-moving vehicles (e.g., operating in a distributed manner on the multiple vehicles, such as on computing devices on each of the multiple vehicles that are interacting in a peer-to-peer manner), or instead remote from one or more such earth-moving vehicles (e.g., in communication with one or more such earth-moving vehicles over one or more networks). In some embodiments, one or more other computing devices or systems may further interact with the ACS 100 (e.g., to obtain and/or provide information), such as one or more other computing devices each having one or more associated users, and/or one or more other computing systems (e.g., to store and provide data, to provide supplemental computing capabilities, etc.). The one or more computing devices may include any computing device or system that may receive data and/or requests and take corresponding actions (e.g., store the data, respond to the request, etc.) in the manners discussed herein.

Figure 2A:
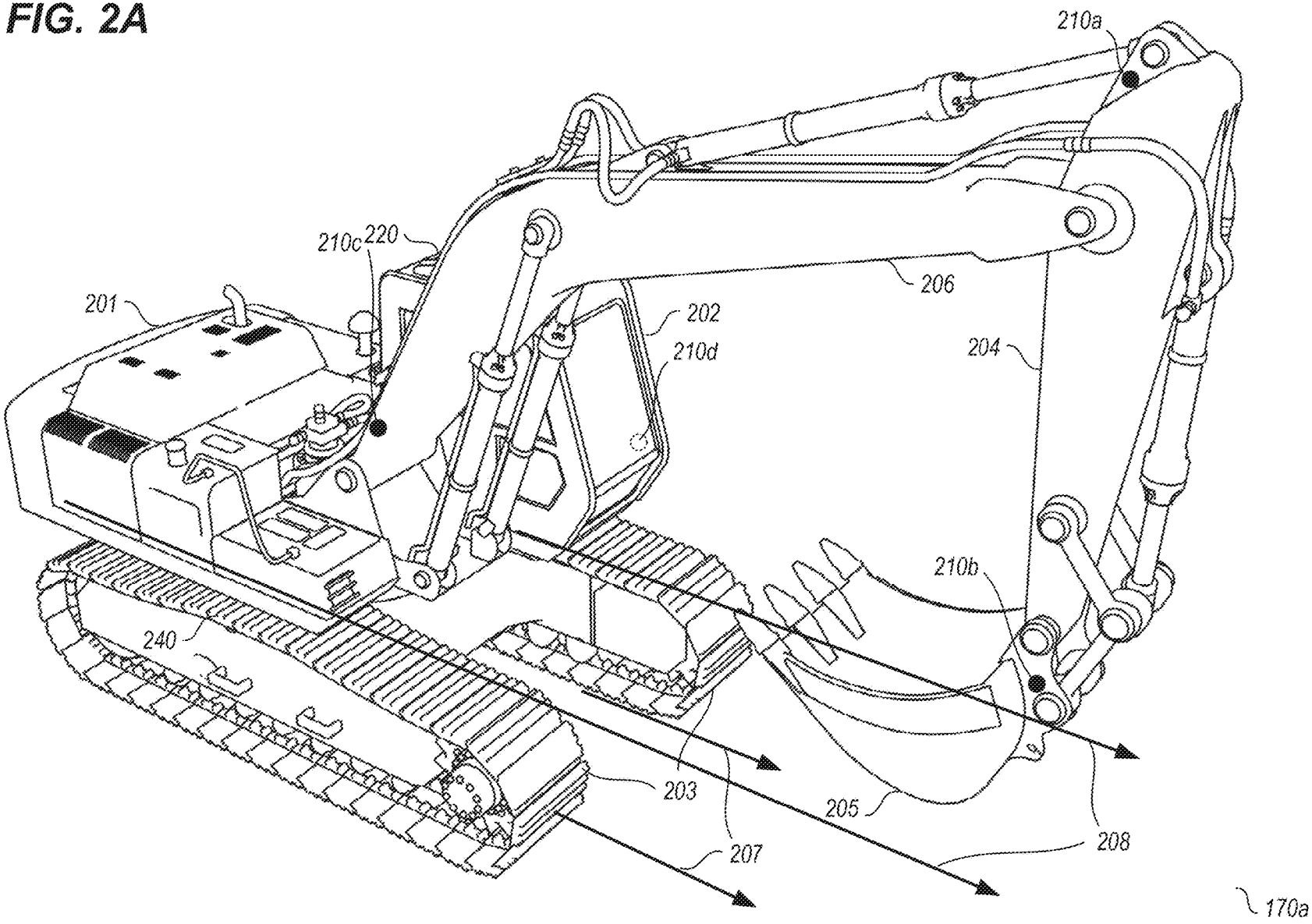
FIGS. 2A-2C illustrate examples of powered earth-moving construction and/or mining vehicles having multiple types of on-vehicle data sensors positioned to support autonomous operations on a site for use with an adaptive control system.
Figure 2B:
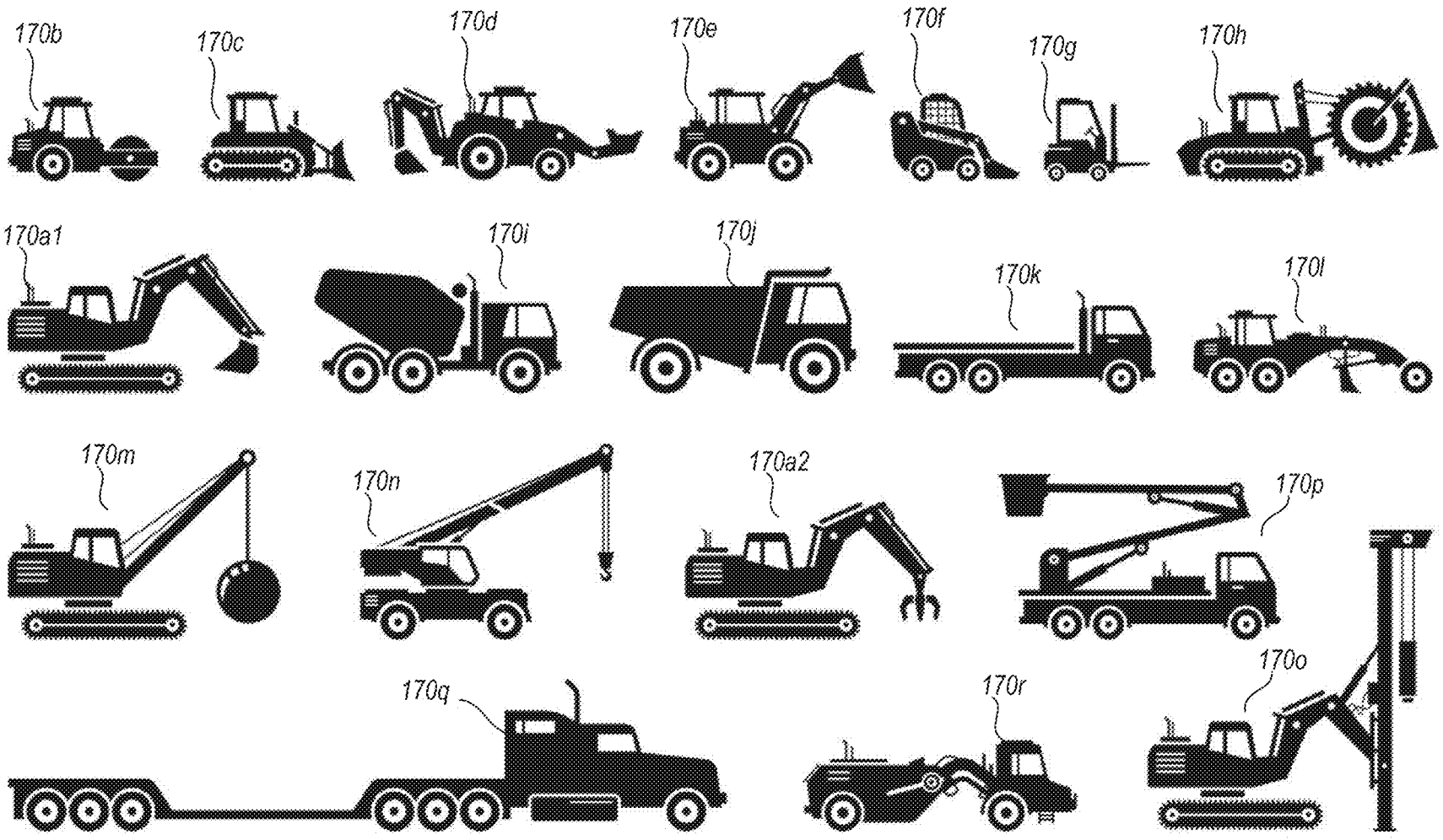
Figure 2C:
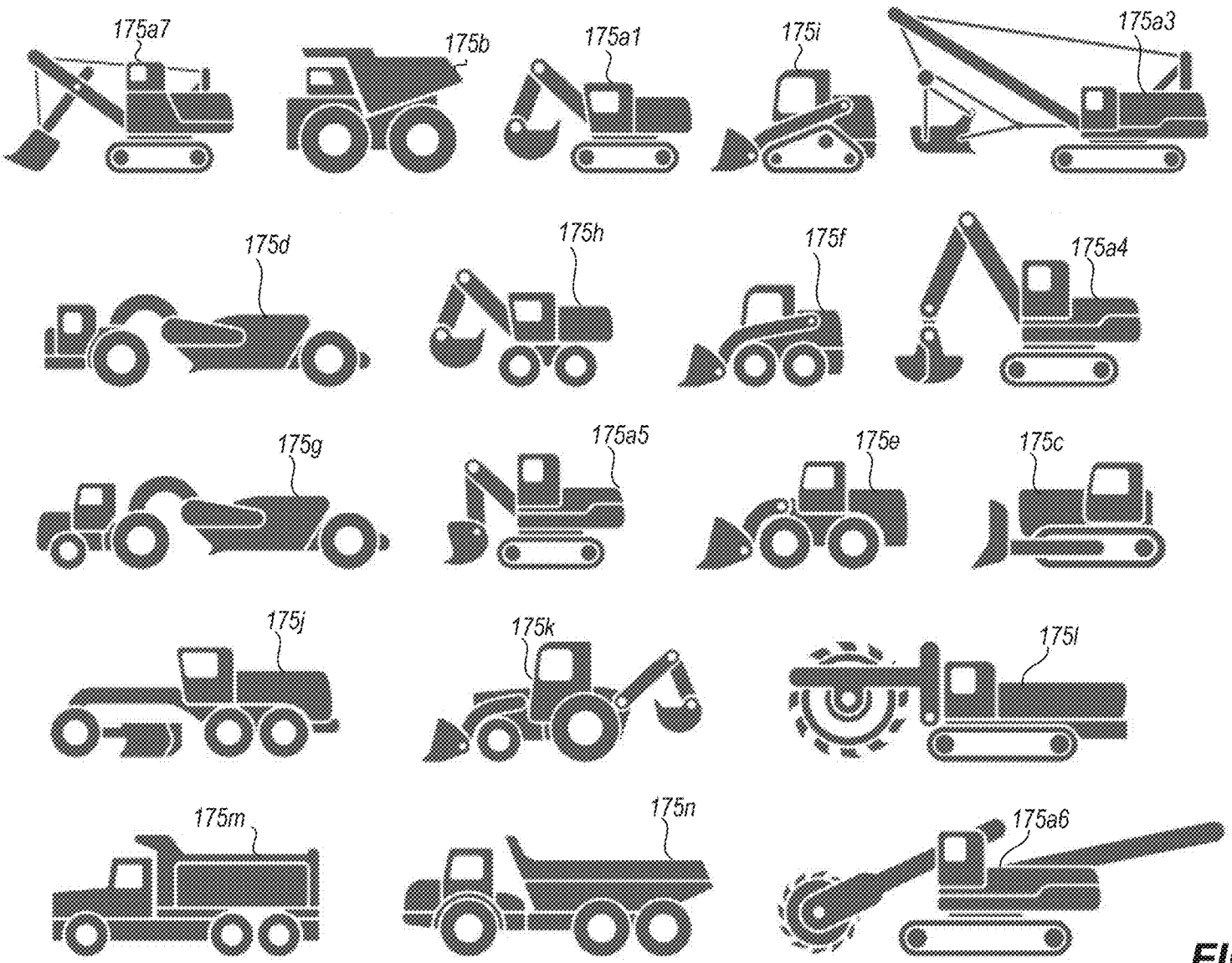

In particular, in this example as shown, and as further shown with respect to FIGS. 2A-2C, an earth-moving vehicle 170/175 (e.g., a construction vehicle 170 and/or a mining vehicle 175), which in this illustrated example is a tracked excavator vehicle 170*a*, includes a variety of sensors to obtain and determine information about the earth-moving vehicle 170 and its surrounding environment (e.g., a job site on which the earth-moving vehicle is located), including one or more GPS antennas 220, an RTK-enabled GPS positioning unit (not shown) that receives GPS signals from the GPS antenna(s) and RTK-based correction data from a remote base station (not shown) and optionally other data from one or more other sensors and/or devices (e.g., an inertial navigation system, not shown), one or more inclinometers and/or other position sensors 210, one or more track sensors 240, one or more image sensors (e.g., part of one or more cameras or other image capture devices, not shown), one or more LiDAR emitters and/or sensors (not shown), one or more infrared sensors (not shown), one or more microcontrollers or other hardware CPUs (not shown), one or more material analysis sensor(s), etc. The ACS 100 and/or the AI system 130 obtains some or all of the data from the sensors on the earth-moving vehicle 170, stores the data in corresponding databases or other data storage formats on storage (e.g., sensor data, position information, location information, vehicle information, environment information, etc.), and uses the data along with an AI system 130 to perform automated operations involving controlling autonomous operations of the earth-moving vehicle.

One or more other earth-moving vehicles 170*x* and/or 175*x* may similarly be present (e.g., on the same job site as earth-moving vehicle 170/175) and include some or all such components and/or the ACS 100 (although not illustrated here for the sake of brevity) and have corresponding autonomous operations controlled by the ACS 100. The computing device(s) 190 may be part of a network (not shown) which may be of one or more types (e.g., the Internet, one or more cellular telephone networks, etc.) and in some cases may be implemented or replaced by direct wireless communications between two or more devices (e.g., via Bluetooth; LoRa, or Long Range Radio; etc.). In addition, other embodiments may similarly gather and use other types of data, whether instead of or in addition to the illustrated types of data, including non-exclusive examples of image data in one or more light spectrums, non-light energy data, location data of types other than from satellite-based navigation systems, depth or distance data to objects, sound data, etc. In addition, in some embodiments and situations, different devices and/or sensors may be used to acquire the same or overlapping types of data (e.g., simultaneously or sequentially), and the ACS 100 may combine or otherwise use such different types of data, including to determine differential information for a type of data.

It will be appreciated that computing devices 190, computing systems and other equipment (e.g., earth-moving vehicle(s)) included within FIGS. 1 and FIGS. 2A-2C are merely illustrative and are not intended to limit the scope of the present invention. The systems and/or devices may instead each include multiple interacting computing systems or devices, and may be connected to other devices that are not specifically illustrated, including via Bluetooth communication, a mesh network, or other direct inter-device communication, through one or more networks such as the Internet, via the Web, or via one or more private networks (e.g., mobile communication networks), etc. More generally, a device or other system may comprise any combination of hardware that may interact and perform the described types of functionality, optionally when programmed or otherwise configured with particular software instructions and/or data structures, including without limitation desktop or other computers (e.g., tablets, slates, etc.), database servers, network storage devices and other network devices, smart phones and other cell phones, consumer electronics, wearable devices, digital music player devices, handheld gaming devices, PDAs, wireless phones, Internet appliances, camera devices and accessories, and various other consumer products that include appropriate communication capabilities. In addition, the functionality provided by the illustrated ACS 100 may in some embodiments be distributed in various components, some of the described functionality of the ACS 100 may not be provided, and/or other additional functionality may be provided.

It will also be appreciated that, while various items may be stored in memory 132 and/or on storage 118 while being used, these items or portions of them may be transferred between memory 132 and other storage devices for purposes of memory management and data integrity and execution/use. Alternatively, in other embodiments some or all of the software components and/or systems may execute in memory on another device and communicate with the illustrated computing systems via inter-computer communication. Thus, in some embodiments, some or all of the described techniques may be performed by hardware means that include one or more processors 112 and/or memory 132 and/or storage 118 when configured by one or more software programs (e.g., by the ACS 100 executing on computing device(s) 190) such as by execution of software instructions of the one or more software programs and/or by storage of such software instructions and/or data structures, and such as to perform algorithms and other techniques as described herein. Furthermore, in some embodiments, some or all of the systems and/or components may be implemented or provided in other manners, such as by consisting of one or more means that are implemented partially or fully in firmware and/or hardware (e.g., rather than as a means implemented in whole or in part by software instructions that configure a particular CPU or other processor), including, but not limited to, one or more application-specific integrated circuits (ASICs), standard integrated circuits, controllers (e.g., by executing appropriate instructions, and including microcontrollers and/or embedded controllers), field-programmable gate arrays (FPGAs), complex programmable logic devices (CPLDs), etc. Some or all of the components, systems and data structures may also be stored (e.g., as software instructions or structured data) on a non-transitory computer-readable storage mediums, such as a hard disk or flash drive or other non-volatile storage device, volatile or non-volatile memory (e.g., RAM or flash RAM), a network storage device, or a portable media article (e.g., a DVD disk, a CD disk, an optical disk, a flash memory device, etc.) to be read by an appropriate drive or via an appropriate connection. The systems, components and data structures may also in some embodiments be transmitted via generated data signals (e.g., as part of a carrier wave or other analog or digital propagated signal) on a variety of computer-readable transmission mediums, including wireless-based and wired/cable-based mediums, and may take a variety of forms (e.g., as part of a single or multiplexed analog signal, or as multiple discrete digital packets or frames). Such computer program products may also take other forms in other embodiments. Accordingly, embodiments of the present disclosure may be practiced with other computer system configurations.

As shown in FIG. 1, the ACS 100 may be operating on one or more computing device(s) 190 and may communicate with an AI system 130 via ethernet, wireless link, closed-loop communication system, or other communication means to provide information to and receive movement commands from the AI system 130. As shown in FIG. 1, the ACS 100 may include, among other things, a machine interface 102, a machine emulator 108, a power system 106, a processor 112, a storage 118, and/or a memory 132.

The machine interface 102 may include software and/or logic for an interface that connects to one or more physical controls of the powered earth-moving construction and/or mining vehicle 170/175. The machine interface 102 may receive inputs representing activation of various controls from the powered earth-moving construction and/or mining vehicle 170/175 and may also send outputs to the various controls of the powered earth-moving construction and/or mining vehicle 170/175. In some implementations, the controls may include safety levers, end stops, implement switches, and/or parking brakes of the earth-moving and/or mining vehicle 170/175. In some implementations, controls may include power inputs/outputs, one or more joysticks, a horn, switches, buttons, transmission controls, one or more pedals, one or more safety levers, etc. The machine interface 102 may receive various input signals from the controls and pass those along to other components of the ACS 100 for further processing, such as by passing those controls to machine learning models for training indicating when to use the buttons and/or levers when generating movement instructions. In some implementations, the machine interface may include software and hardware components for connecting to the various controls, buttons, switches, and/or levers of the powered earth-moving construction and/or mining vehicle 170/175. In some implementations, the machine interface 102 provides signals to the power system 106, such as when a power control or transmission control of the powered earth-moving construction and/or mining vehicle 170/175 is activated and the machine interface 102 can send that command to the power system 106 to turn on/off the power or adjust the power system 106 based on the command.

The ACS 100 may include one or more power system(s) 106 that cause the powered earth-moving construction and/or mining vehicle 170/175 and/or the components of the powered earth-moving construction and/or mining vehicle 170/175 to operate. In some implementations, the power system 106 may be the power system 106 originally installed in the powered earth-moving construction and/or mining vehicle 170/175 (e.g., the machine voltage). In some implementations, the earth-moving construction and/or mining vehicle 170/175 takes the power supplied by the vehicle system (e.g., the machine voltage) and converts that power supply for use by the ACS 100.

The ACS 100 may include one or more machine emulators 108. The machine emulators 108 may each include software and/or logic for an interface that allows the ACS 100 to emulate various physicals controls, such as a physical safety lever, physical end stop, physical implement switch, and/or physical parking brake, using one or more of a virtual safety lever 120, virtual end stop 122, virtual implement switch 124, and/or virtual parking brake 126. These virtual components that mimic corresponding physical components allow the machine emulator 108 to inject signals that emulate physical control signals from physical activation of those buttons and/or switches and produce resulting conditions for control of the powered earth-moving vehicle using the virtual components. This allows the machine emulator 108 to provide control into the physical components while also preserving the original operating ability of the physical controls. This machine emulator 108 provides for layered system control where the physical controls can be used to control the system or the machine emulator 108 can provide virtual control from the ACS 100. In some implementations, the machine emulator 108 may operate as a plurality of configurable jumpers that allow switches to work in different configurations as described with respect to FIG. 3. This system enables the ACS 100 to allow physical controls to pass through, so that a human operator would not be able to tell the difference between effects of using the physical controls or of mimicking virtual controls via the machine emulator as described elsewhere herein.

The ACS 100 may include a processor 112 that uses software and/or logic to receive various signals from the machine emulator 108 and/or bypass the machine emulator 108 and receive input signals directly from the machine interface 102. The processor 112 can provide output instructions that mimic activation of the physical controls using the machine emulator 108 and/or the components of the machine emulator 108, such as the virtual safety lever 120, the virtual end stop 122, the virtual implement switch 124, and/or the virtual parking brake 126. In some implementations, the processor 112 may be configured to send and/or receive information from the AI system 130, such as providing control signals received from the machine interface 102 to the AI system 130, and receiving movement commands in the form of output signals that can be sent to machine emulator 108 and or other signal lines of the ACS 100 for control of the earth-moving construction and/or mining vehicles 170/175. In some implementations, the processor 112 may generate sets of movement instructions based on the incoming signals from various components of the earth-moving construction and/or mining vehicles 170/175 and/or any machine learning instructions from the AI system 130. The processor 112 may then provide the generated sets of movement instructions to the corresponding components of the earth-moving construction and/or mining vehicles 170/175.

FIG. 2A illustrates examples of an excavator vehicle as a type of powered earth-moving construction and/or mining vehicle 170/175 having multiple types of on-vehicle data position sensors 210 positioned to support autonomous operations on a site.

In particular, with respect to FIG. 2A, an example excavator vehicle 170*a* is illustrated using an upper-side-frontal view from the side of the digging boom arm 206 and stick arm (or 'stick') 204 and opposite the side of the cabin 202, with the excavator vehicle further having a main body chassis 201 (e.g., enclosing an engine and counterweight, and including the cabin 202), tracks 203 and bucket (or 'scoop' or 'claw') tool attachment 205—in other embodiments, tool attachments other than a bucket may be used such as, for example, a hydraulic thumb, coupler, breaker, compactor, digging bucket, grading bucket, hammer, demolition grapple, tiltrotator, etc. In the example embodiment, four example position sensors (such as inclinometers) 210*a*-201*d* are further illustrated at positions that beneficially provide position data to compute the location of the bucket 205 and other parts of the digging boom arm 206/stick arm 204 relative to the cabin 202 of the excavator vehicle 170/175. In this example, three position sensors 210*a*-210*c* are mounted at respective positions on the digging boom arm 206/stick arm 204 of the excavator vehicle (position 210*c* near the intersection of the digging boom arm and the body of the excavator vehicle, position 210*b* near the intersection of the digging stick arm and the bucket tool attachment, and position 210*a* near the intersection of the digging boom arm and stick arm), and with a fourth position sensor 210*d* mounted within the cabin of the excavator vehicle and illustrated at an approximate position using a dashed line, such as to use a dual-axis inclinometer that measures pitch and roll—data from the inclinometers may be used, for example, to track the position of the excavator boom arm/stick arm/tool attachment, including when a track heading direction 207 is determined to be different from a cabin/body heading direction 208 (not shown in this example). It will be appreciated that other quantities, positionings and types of inclinometers may be used in other embodiments. In some implementations, the excavator vehicle may also include GPS antennas 220 at positions that beneficially provide GPS data to assist in determining the positioning and direction of the cabin/body, including to use data from the three GPS antennas to provide greater precision than is available from a single GPS antenna. In this example, the GPS antenna 220 may be positioned on the earth-moving body chassis and proximate to three corners of the chassis (e.g., as far apart from each other as possible, such as at as a forward position on the left side of the cabin, a backward position on the left side of the cabin, and a forward position on the right side of the cabin), such that differential information between GPS antennas 220 may provide cabin heading direction information, and lateral direction information at approximately 90° from that cabin heading direction information.

FIG. 2B continues the example of FIG. 2A, with FIG. 2B illustrating information about a variety of non-exclusive example types of powered earth-moving construction vehicles 170 that may be controlled by embodiments of the ACS 100, including two example earth-moving tracked construction excavator vehicles 170*a* shown with different attachments (excavator vehicle 170*a*1 with a bucket attachment, and excavator vehicle 170*a*2 with a grapple attachment) that may be controlled by the ACS 100. Other example types of earth-moving construction vehicles 170 that are illustrated include a bulldozer 170*c*; a backhoe loader 170*d*; a wheel loader 170*e*; a skid steer loader 170*f*; a dump truck 170*j*; a forklift 170*g*; a trencher 170*h*; a mixer truck 170*i*; a flatbed truck 170*k*; a grader 1701; a wrecking ball crane 170*m*; a truck crane 170*n*; a cherry picker 170*p*; a heavy hauler 170*q*; a scraper 170*r*; a pile driver 1700; a road roller 170*b*; etc. It will be appreciated that other types of earth-moving construction vehicles may similarly be controlled by the ACS 100 in other embodiments. In a similar manner, FIG. 2C illustrates information about a variety of non-exclusive example types of earth-moving mining vehicles 175 that may similarly be controlled by embodiments of the ACS 100, including several example earth-moving tracked mining excavator vehicles 175*a* shown with different attachments (excavator vehicle 175*a*1 with a bucket attachment, excavator vehicle 175*a*3 with a dragline attachment, excavator vehicle 175*a*4 with a clamshell extractor attachment, excavator vehicle 175*a*5 with a front shovel attachment, excavator vehicle 175*a*6 with a bucket wheel extractor attachment, excavator vehicle 175*a*7 with a power shovel attachment, etc.) that may be controlled by the ACS 100. Other example types of earth-moving mining vehicles 175 that are illustrated include a dump truck 175*m*; an articulated dump truck 175*n*; a mining dump truck 175*b*; a bulldozer 175*c*; a scraper 175*d*; a tractor scraper 175*g*; a wheel loader 175*e*; a wheeled skid steer loader 175*f*; a tracked skid steer loader 175*i*; a wheeled excavator 175*h*; a backhoe loader 175*k*; a motor grader 175*j*; a trencher 175*l*; etc.

Figure 3:
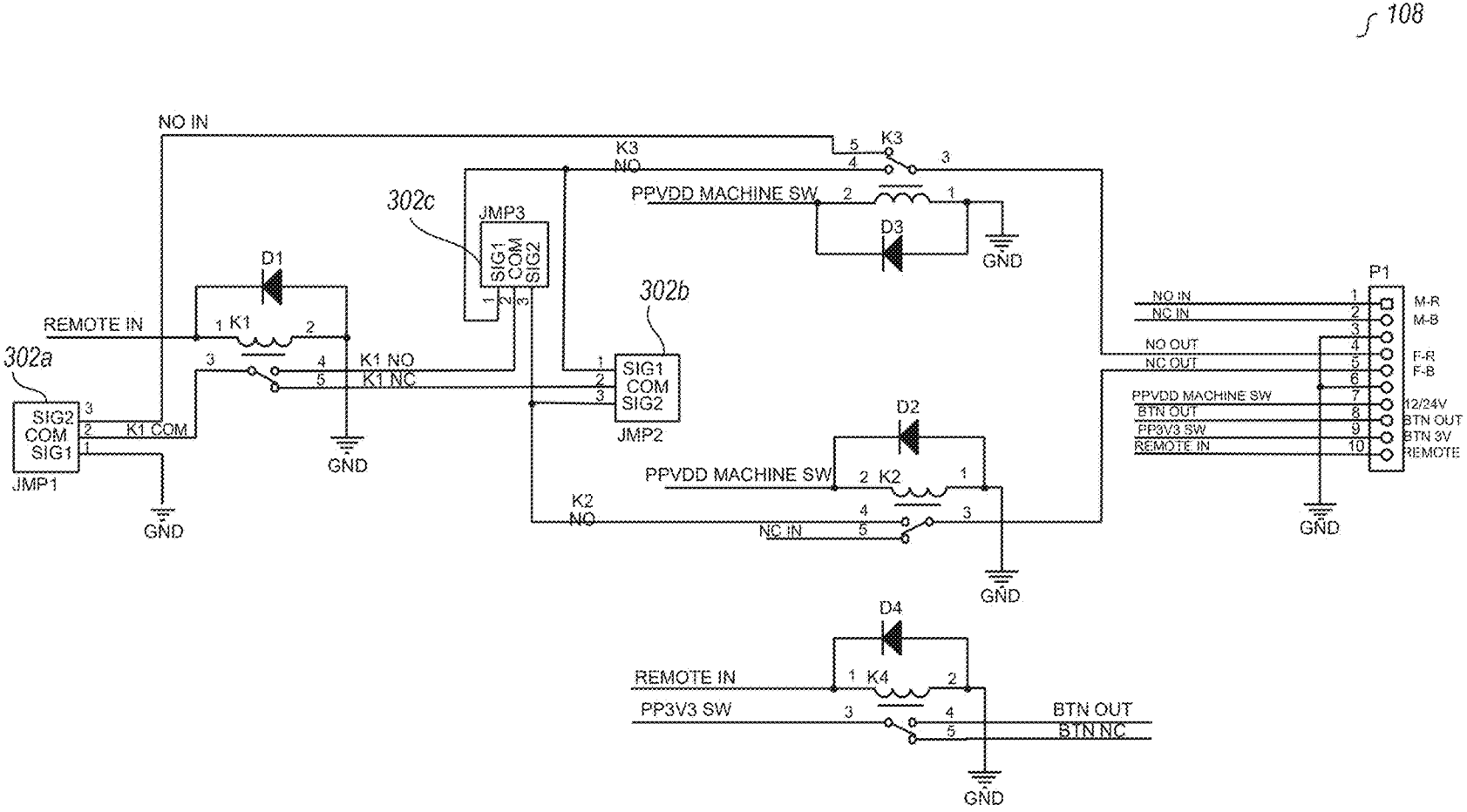
FIG. 3 illustrates an example circuit diagram of a machine emulator.

FIG. 3 is an example circuit diagram of a machine emulator 108. It should be understood that the example depicted in FIG. 3 is just one example of a machine emulator 108 and other options are also contemplated. As shown in the example, the machine emulator 108 implementation may include one or more configurable jumpers 302 that allow the machine emulator 108 to function as a switch in a variety of scenarios. As shown in the example in FIG. 3, the first jumper 302*a* enables emulating a button which can switch a grounded COM to a powered NC (Normally Closed—e.g., circuit open means on) or NO (Normally Open—e.g., circuit closed means on) pin. In some implementations, the first jumper 302*a* also allows emulating a button which switches a signal based (high impedance COM) to an NC or NO pin, which in some implementations may be powered with a static voltage or in other implementations may be a variable signal.

As shown in FIG. 3, the second jumper 302*b* enables the K1 relay NC side to be connected to K3 NO or K2 NO. As shown in FIG. 3, the third jumper 302*c* enables the K1 relay NO side to be connected to K3 NO or K2 No. This combination of the second jumper 302*b* and the third jumper 302*c* allows for the inputs K1 NC and K1 NO from relays K3 and K2 can be swapped. Using the combination of jumpers, the different inputs can be controlled to provide functionality to different aspects of the physical controls. Additionally, as shown in FIG. 3, using the combination of jumpers 302, different voltage levels, such as a machine voltage (for example 12 V or 24 V) can be used to emulate physical high voltage signals. In other implementations, a lower voltage, such as 3V or variable low voltage, can be used to mimic various physical components using the machine emulator 108. It should also be understood that while three jumpers 302 are used with respect to the example in FIG. 3, more complex jumper configurations using additional jumpers can be used to provide additional controls in other implementations. In some implementations, the jumper 302 may be implemented as software configurable via a bit mask that is amplified to provide appropriate voltages, where each bit has a designated relay to select a routing path. In some implementations, the machine emulator 108 may split out each relay COM, NC, and NO signal back to a connector so that it can be read by a diagnostic system and provide further information back to the ACS 100.

Figure 4:
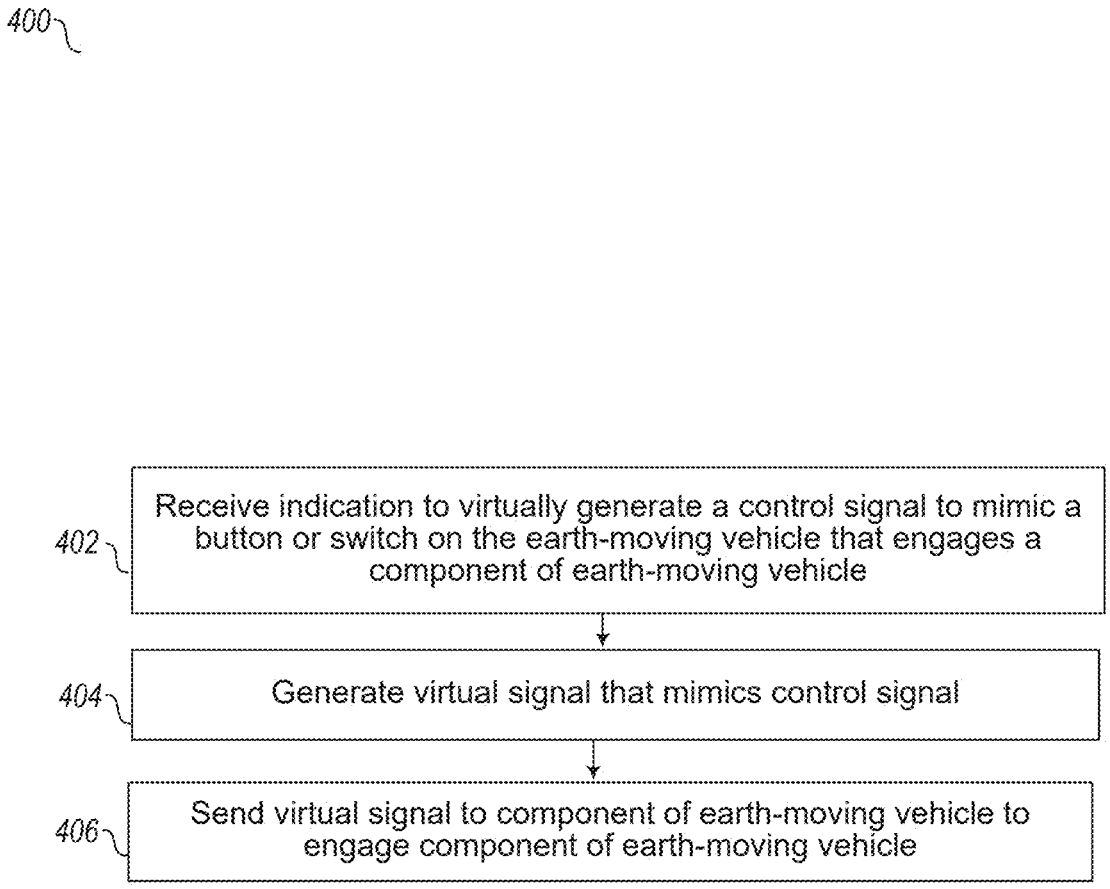
FIG. 4 illustrates an example method of using an adaptive control system of one or more powered earth-moving construction and/or mining vehicles on a site.

FIG. 4 illustrates an example method flowchart 400 of using an adaptive control system of one or more powered earth-moving construction and/or mining vehicles on a site. At 402, the ACS 100 can receive one or more indications to virtually generate a control signal to mimic a physical control on the earth-moving construction and/or mining vehicles 170/175, such as a button, switch, pedal, joystick, etc. The control signal can represent a command to engage a component of earth-moving construction and/or mining vehicles 170/175, such as a safety lever, end stop, implement switch, and/or parking brake. The indication can be an autonomously generated set of movement instructions that includes an indication to engage the component of the earth-moving construction and/or mining vehicles 170/175, such as a command to set a parking brake or safety lever during the execution of a movement instruction. The ACS 100 can determine that the virtual signal that mimics the control signal should be generated without any input from an operator, e.g., the ACS 100 is operating the earth-moving construction and/or mining vehicles 170/175 autonomously without any physical control inputs In further implementation, instead of receiving an indication to virtually generate a control signal, a machine interface 102 can receive one or more physical control signals from a physical control of the earth-moving construction and/or mining vehicles 170/175, such as a button, switch, pedal, joystick, etc. The control signal can represent a command to engage or actuate a component of an earth-moving vehicle, such as a safety lever, end stop, implement switch, and/or parking brake. In other implementations, the control signal can further include signals to a component of the earth-moving construction and/or mining vehicles 170/175 that causes the earth-moving construction and/or mining vehicles 170/175 to operate, such as a bucket, tread, arm, blade, etc. as shown with respect to FIGS. 2A-2C. In some implementations, the control signals received at the machine interface may be used to train machine learning models and the ACS 100 can use the physical control signals to identify when a virtual signal should be injected as part of a set of movement instructions. In some implementations, the earth-moving construction and/or mining vehicles 170/175 may be operating completely autonomously, and the machine interface 102 does not receive any control signals as an operator may not be inputting control signals at the physical control. Instead, the ACS 100 may generate one or more commands for autonomous operation and the machine emulator 108 may inject virtual signals to one or more components of the earth-moving vehicle based on the generated commands, without any physical control inputs. In this implementation, the virtual signals mimic physical control inputs from the perspective of the component of the earth-moving construction and/or mining vehicles 170/175. In these implementations, the ACS 100 may not interrupt the physical control signal, as no physical control signal is input and instead the ACS 100 operates on autonomous control by generating movement instructions based on sensor data and identifying when a virtual signal needs to be injected by the machine emulator 108. In further implementations, the control signal from the physical control is received at an earlier point in time and the virtual signals are injected at a later point in time based on the ACS 100 using these learning models with machine learning algorithms.

At 404, a machine emulator 108 can generate a virtual signal that mimics the control signal such that a component of the earth-moving construction and/or mining vehicles 170/175 would not be able to differentiate between the control signal and the virtual signal when a command is sent to the component of the earth-moving and/or mining vehicles 170/175. In some implementations, the virtual signal can be emulated as a plurality of jumpers as described elsewhere herein, while in further implementations, the virtual signals can be emulated as software and/or logic that can provide the command to the component of the earth-moving construction and/or mining vehicles 170/175 as described elsewhere herein. At 406, the ACS 100 can send the virtual signal to the component of the earth-moving construction and/or mining vehicles 170/175 to cause the component of the earth-moving construction and/or mining vehicles 170/175 to be engaged, such as engaging a parking brake, end stop, safety lever, and/or implement switch, etc. This allows for the ACS 100 to send virtual signals that mimic the control signals to the components of the earth-moving construction and/or mining vehicles 170/175 and make it appear as if the control signals are providing the commands directly from the button and/or switch.

In further implementations, when the ACS 100 is operating autonomously and a physical control signal representing an interaction with a button or switch (such as a pressing or flipping) on the earth-moving construction and/or mining vehicles 170/175 is received, this physical control signal may cause the ACS 100 to interrupt the virtual signal being sent to the component of the earth-moving construction and/or mining vehicles 170/175 and instead the physical control signal is sent to the component of the earth-moving construction and/or mining vehicles 170/175. For example, when the ACS 100 is operating autonomously, an operator of the earth-moving construction and/or mining vehicles 170/175 may activate a button or switch that overrides or interrupts the autonomous operation and injects the physical control into the earth-moving construction and/or mining vehicles 170/175. Such as where a safety lever or end stop needs to be engaged, this command can override and interrupt the autonomous control.

Aspects of the present disclosure are described herein with reference to flowchart illustrations and/or block diagrams of methods, apparatus (systems), and computer program products according to embodiments of the present disclosure. It will be appreciated that each block of the flowchart illustrations and/or block diagrams, and combinations of blocks in the flowchart illustrations and/or block diagrams, can be implemented by computer readable program instructions. It will be further appreciated that in some implementations the functionality provided by the routines discussed above may be provided in alternative ways, such as being split among more routines or consolidated into fewer routines. Similarly, in some implementations illustrated routines may provide more or less functionality than is described, such as when other illustrated routines instead lack or include such functionality respectively, or when the amount of functionality that is provided is altered. In addition, while various operations may be illustrated as being performed in a particular manner (e.g., in serial or in parallel, or synchronous or asynchronous) and/or in a particular order, in other implementations the operations may be performed in other orders and in other manners. Any data structures discussed above may also be structured in different manners, such as by having a single data structure split into multiple data structures and/or by having multiple data structures consolidated into a single data structure. Similarly, in some implementations illustrated data structures may store more or less information than is described, such as when other illustrated data structures instead lack or include such information respectively, or when the amount or types of information that is stored is altered.

From the foregoing it will be appreciated that, although specific embodiments have been described herein for purposes of illustration, various modifications may be made without deviating from the spirit and scope of the invention. Accordingly, the invention is not limited except as by corresponding claims and the elements recited therein. In addition, while certain aspects of the invention may be presented in certain claim forms at certain times, the inventors contemplate the various aspects of the invention in any available claim form. For example, while only some aspects of the invention may be recited as being embodied in a computer-readable medium at particular times, other aspects may likewise be so embodied.

What is claimed is:

1. A configurable system for layered control of an earth-moving vehicle, comprising:

a physical control of the earth-moving vehicle that when activated causes physical control data to be sent to a component of the earth-moving vehicle to cause an actuation of the component of the earth-moving vehicle;

a machine interface that receives the physical control data from the physical control and interrupts the actuation of the component of the earth-moving vehicle;

a machine emulator that receives the physical control data and generates a virtual signal mimicking the physical control data; and an adaptive control system that receives the virtual signal mimicking the physical control signal and enables the virtual signal to cause the actuation of the component of the earth-moving vehicle in place of the physical control data.

2. The configurable system of claim 1 wherein the machine interface interrupts the actuation of the component of the earth-moving vehicle by causing the physical control data to not be sent to the component of the earth-moving vehicle.

3. The configurable system of claim 1 wherein the physical control is a button on the earth-moving vehicle that is activated by a user physically pressing the button.

4. The configurable system of claim 1 wherein the physical control is a switch on the earth-moving vehicle that is activated by a user physically moving the switch.

5. The configurable system of claim 1 wherein the component of the earth-moving vehicle is one or more of a safety lever, or an end stop, or an implement switch, or a parking brake.

6. The configurable system of claim 5 wherein causing the actuation of the component of the earth-moving vehicle includes causing the one or more of the safety lever or the end stop or the implement switch or the parking brake to be engaged.

7. The configurable system of claim 5 wherein the machine emulator includes a plurality of jumpers, and wherein generating of the virtual signal includes activating the plurality of jumpers to switch a grounded COM to a powered pin when activated.

8. The configurable system of claim 7 wherein the generating of the virtual signal further includes causing the plurality of jumpers to swap inputs.

9. A configurable system for layered control of an earth-moving vehicle, comprising:

a machine interface that is configured to receive and transmit control signals of one or more of a button or a switch of the earth-moving vehicle;

a machine emulator that is configured to generate a virtual signal mimicking the control signals of the one or more of the button or the switch of the earth-moving vehicle; and an adaptive control system that is configured to generate a set of movement instructions of the earth-moving vehicle, the adaptive control system receiving the virtual signal mimicking the control signal and enabling the virtual signal to effect an actuation of the earth-moving vehicle, the actuation mimicking the control signal of the one or more of the button or the switch of the earth-moving vehicle based on the virtual signal and the set of movement instructions.

10. The configurable system of claim 9 wherein the control signals of the one or more of the button or the switch represent control signals from one or more of a safety lever, or an end stop, or an implement switch, or a parking brake.

11. The configurable system of claim 9 wherein the machine emulator includes a jumper that emulates the one or more of the button or the switch performing, when activated, switching of a grounded COM to a powered pin.

12. The configurable system of claim 11 wherein the jumper is implemented as software configured via an amplified bit mask.

13. The configurable system of claim 12 wherein the amplified bit mask includes a plurality of relays, wherein each relay of the plurality of relays selects a different one of multiple routing paths.

14. The configurable system of claim 13 wherein each of the plurality of relays provides a signal back to a connector that is read by a diagnostic system.

15. The configurable system of claim 9 wherein the machine emulator includes a plurality of configurable jumpers that enable inputs of two or more of the jumpers from the plurality of jumpers to be swapped.

16. The configurable system of claim 9 wherein the adaptive control system generates the set of movement instructions of the earth-moving vehicle by determining a current location of the earth-moving vehicle, and determining a next action of the earth-moving vehicle based on the current location of the earth-moving vehicle and the virtual signal.

17. A method of using a configurable system for layered control of an earth-moving vehicle, comprising:

receiving an indication of a control signal resulting from activation of one or more of a physical button or a physical switch on the earth-moving vehicle, the control signal representing a command to engage a component of the earth-moving vehicle;

generating a virtual signal based on the control signal, the virtual signal mimicking the control signal; and sending the virtual signal to the component of the earth-moving vehicle to engage the component of the earth-moving vehicle.

18. The method of claim 17 wherein the virtual signal emulates the control signal using a plurality of jumpers.

19. The method of claim 18 wherein the component of the earth-moving vehicle is one or more of a safety lever, or an end stop, or an implement switch, or a parking brake.

20. The method of claim 17 wherein the indication of the control signal is an instruction to virtually generate the control signal to mimic the activation of the one or more of the physical button or the physical switch.

21. The method of claim 17 wherein the receiving of the indication of the control signal includes receiving a physical control signal from a physical interaction with the one or more of the physical button or the physical switch, wherein the method further comprises causing the physical control signal to be interrupted before engaging the component of the earth-moving vehicle, and wherein the virtual signal is sent to the component of the earth-moving vehicle in place of the physical control signal.

22. The method of claim 17 wherein the receiving of the indication of the control signal includes receiving a physical control signal from a physical interaction with the one or more of the physical button or the physical switch, wherein the method further comprises performing the sending of the virtual signal to the component of the earth-moving vehicle by replacing the virtual sign with the physical control signal during the sending.

* * * * *